United States Patent [19]

Elliott

[11] Patent Number: 4,814,949

[45] Date of Patent: Mar. 21, 1989

[54] CHEMILUMINESCENT DEVICE

[75] Inventor: Laura Elliott, Norwalk, Conn.

[73] Assignee: American Cyanamid Company, Stamford, Conn.

[21] Appl. No.: 120,281

[22] Filed: Nov. 13, 1987

[51] Int. Cl.[4] ..... F21K 2/06

[52] U.S. Cl. ..... 362/34; 362/159; 252/700

[58] Field of Search ..... 362/34, 159; 252/700

[56] References Cited

U.S. PATENT DOCUMENTS

| | | | |
|---|---|---|---|
| 3,354,828 | 11/1967 | Shefler et al. | 362/34 |
| 3,515,070 | 6/1970 | Cutler et al. | 252/700 X |
| 3,539,794 | 11/1970 | Rauhut et al. | 362/34 |
| 3,576,987 | 5/1971 | Voight et al. | 352/700 X |
| 3,729,425 | 4/1973 | Heller et al. | 252/700 |
| 3,732,413 | 5/1973 | Shefler et al. | 362/34 |
| 3,816,325 | 6/1974 | Rauhut et al. | 362/34 X |
| 4,064,428 | 12/1977 | Van Zandt | 362/34 |
| 4,379,320 | 4/1983 | Mohan et al. | 362/34 |
| 4,405,973 | 9/1983 | Moscarillo | 362/34 |
| 4,635,166 | 1/1987 | Cameron | 362/34 |

*Primary Examiner*—Ira S. Lazarus
*Assistant Examiner*—Richard R. Cole
*Attorney, Agent, or Firm*—Frank M. Van Riet

[57] ABSTRACT

A chemiluminescent device is disclosed wherein a first polymeric sheet having a shaped cavity therein is sealed around its periphery to a second polymeric sheet and the cavity contains (1) an absorbent article produced from a polyolefin, or a polyester or glass fibers and being of substantially the same shape as the cavity and (2) a sealed receptacle containing a first liquid component of a chemiluminescent light composition and wherein there is also present, outside said sealed receptacle, a second liquid component of a chemiluminescent light composition, said absorbent article conforming to seven critical chemical limitations.

19 Claims, 1 Drawing Sheet

CHEMILUMINESCENT DEVICE

BACKGROUND OF THE INVENTION

The production of devices capable of emitting light through chemical means is well known in the art. Chemiluminescent lightsticks, for example, are taught by U.S. Pat. No. 3,539,794. Other configurations of devices for emitting chemical light have also been the subject of many U.S. patents, see, for example U.S. Pat. Nos. 3,350,553; 3,729,425 and 3,893,938. A recent patent, U.S. Pat. No. 4,635,166 has also issued directed to an emergency light and containing a reflector. The above-mentioned patents are hereby incorporated herein by reference.

The devices of the prior art, while satisfying some specific needs, have generally not received wide-spread commercial acceptance because they fail in one or more critical areas. The devices of U.S. Pat. No. 3,350,553, for example, must be activated by air which requires some means for accessing the air, which means are subject to failure such as by leaking etc. Other devices have failed commercially because of their inability to emit light over the required period of time while others emit poor quantities of light, do not concentrate the light in a centralized area, require too much chemical to be commercially attractive from an economic standpoint, do not emit light over a uniform area, etc.

Accordingly, industry is continually on the lookout for chemiluminescent devices which overcome most, if not all, of the deficiencies mentioned above, which devices are economically attractive to the consumer and are relatively simply manufactured by the manufacturer.

SUMMARY OF THE INVENTION

There is disclosed herein a novel chemiluminescent device which overcomes many of the deficiencies of the prior art disclosed devices. The device is easily manufactured, enables the use of quantities of chemicals which are economically attractive to the manufacturer and therefore also to the consumer while still resulting in a high light output over a period of time, which output may be adjusted by their specific selection, emits light in a uniform manner and otherwise constitutes a desirable, attractive, aesthetic article of manufacture.

BRIEF DESCRIPTION OF THE DRAWINGS

The invention may be better understood by reference to the drawing in which.

DETAILED DESCRIPTION OF THE DRAWINGS

Figure 1:
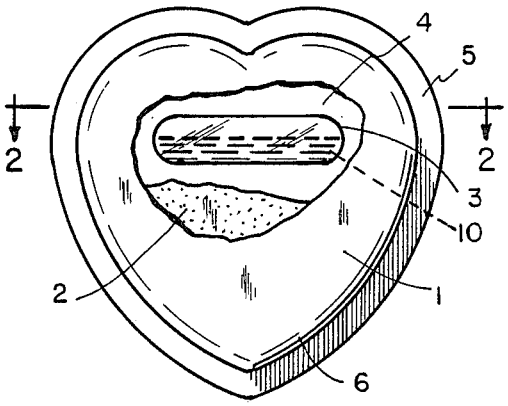
FIG. 1 depicts a break-away view of a chemiluminescent device in the shape of a heart.

Referring to FIG. 1, the chemiluminescent device comprises a first polymeric sheet 1 having a cavity therein in the shape of a heart 6, a non-woven, liquid-absorbent article 2 of substantially the same shape as the cavity in sheet 1. Article 2 is depicted as having absorbed thereon a quantity of a component of a chemiluminescent light composition. Sealed, breakable receptacle 3 is shown as a glass ampule containing a quantity of another component 10 of a chemiluminescent light composition. Second polymeric sheet 4 comprises the backmost surface of the device, sheets 1 and 4 being sealed together at 5 around the periphery of the device.

Figure 2:
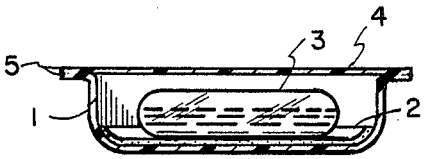
FIG. 2 depicts a cross-sectional view of the device of FIG. 1 taken along line 2—2 thereof.

FIG. 2 is a cross-section of the device across line 2—2 shown the cavity of about 1 containing the shape-conforming liquid-absorbent article 2, receptacle 3 and sheet 4. Sheets 1 and 4 are sealed, such as be heat sealing, gluing, sonic sealing etc. at seam 5.

Figure 3:
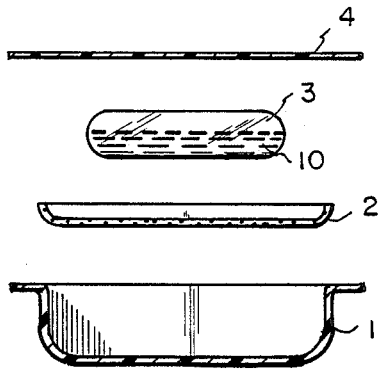
FIG. 3 depicts an exploded view of the device of FIG. 1 showing the pre-assembled components thereof.

The individual components of the device of FIG. 1 are showing in an exploded view in FIG. 3, article 2 substantially conforming in shape to the cavity of sheet 1 and receptacle 3 containing chemiluminescent composition component 10.

Figure 4:
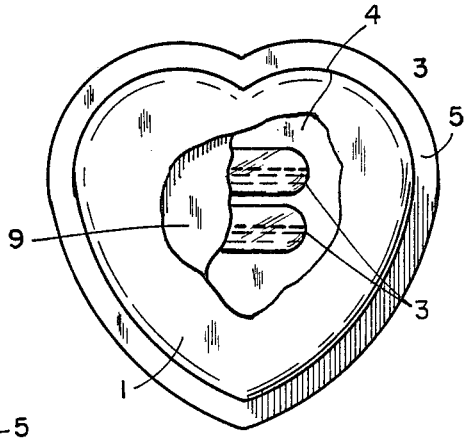
FIG. 4 depicts a break-away view of a chemiluminescent device in the shape of a heart and having two rupturable or breakable receptacles.
Figure 5:
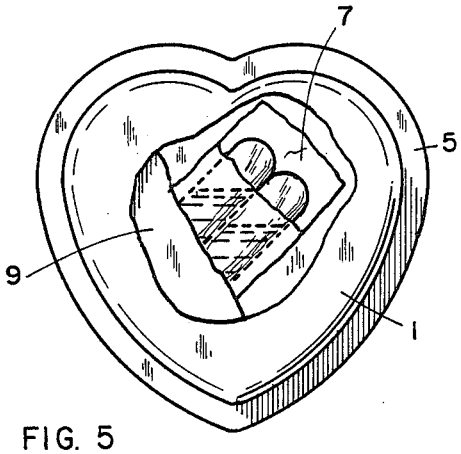
FIG. 5 depicts a break-away view of a chemiluminescent device in the shape of a heart and having two rupturable or breakable receptacles which are encased in an open ended containment pouch.
Figure 6:
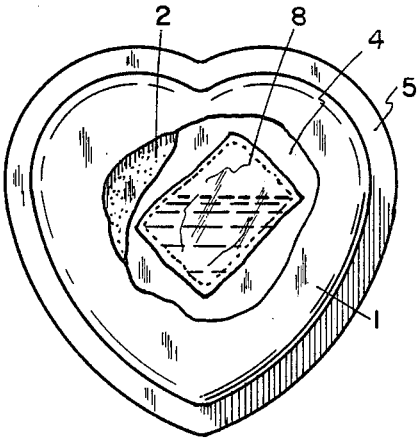
FIG. 6 depicts a chemiluminescent device in a break-away view of a chemiluminescent device in the shape of a heart wherein the rupturable receptacle is in the form of a pouch.
Figure 7:
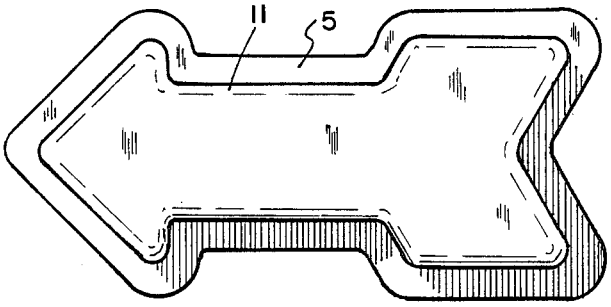
FIG. 7 depicts a chemiluminescent device in the shape of an arrow.

FIGS. 4–6 depict variations of the chemiluminescent devices of the present invention wherein two breakable receptacles 3 are shown in FIG. 4, liquid-absorbent article 9 being depicted in a dry condition since the receptacles each contain one of the components of the chemiluminescent light composition which, when admixed, result in the formation of the light. In FIG. 5, the two receptacles are encased in a containment pouch 7 having one open edge in order to assist in keeping the chemiluminescent light composition components abutting one another to assure good mixing thereon upon rupturing of the receptacles. FIG. 6 shows a variation where one component of the chemiluminescent light composition is present in a rupturable pouch 8. Again, article 2 is shown as containing absorbed therein the other component as in FIG. 1. The arrow shape of FIG. 7 is representative of the hundreds of shapes into which the devices of the instant invention can be formed.

DESCRIPTION OF THE INVENTION INCLUDING PREFERRED EMBODIMENTS

The instant invention is directed to a chemiluminescent device comprising, in sequential relationship, A. a first polymeric sheet, being transparent or translucent and having a shaped cavity therein, said cavity capable of receiving a liquid-absorbent article, B. a non-woven, liquid-absorbent article made from a polyolefin or a polyester or glass fiber, said article being of substantially the same shape as said cavity, C. a first sealed receptacle containing a first liquid component of a chemiluminescent light composition capable of providing chemiluminescent light when mixed with a second component, D. a second liquid component of a chemiluminescent light composition outside said first sealed receptacle, and E. a second polymeric sheet sealed around its periphery to the periphery of said first polymeric sheet, said liquid - absorbent article:

(i) being capable of absorbing and retaining substantially the complete volume of said chemiluminescent light composition to thereby result in substantially complete saturation of the article;
(ii) being capable of allowing mixing of said first and second components of said composition after being absorbed thereby;
(iii) having a uniform density across its widest surface;
(iv) being inert with regard to said composition and said first and second components;
(v) being substantially non-deformable in use in said device;
(vi) being capable of substantially instantaneous absorption of said first and second components, alone or when admixed, and
(vii) being opaque when substantially completely saturated with said chemiluminescent composition.

Considering the elements of the device of the instant invention in the sequence presented above, the first polymeric sheet is flexible, transparent or translucent and chemically inert. It has a shape retaining memory and toughness which resists bursting from internal or external pressure and discourages puncture. It is produced from a polyolefin, preferably polyethylene, polypropylene, or copolymers thereof and can range from about 0.01 to about 0.05 inch in thickness, preferably from about 0.02 to about 0.04 inch. A circumferentially raised rib may be incorporated into its exterior face around the periphery of the shaped cavity to help prevent accidental activation of the device. The sheet may be either injection molded or thermoformed. The cavity can be in any desired shape such as a geometric shape, i.e., square, rectangle, circle, cross, etc., or an arrow, letter, heart, number, etc. Indicia may be printed or otherwise imparted to either surface of the first polymeric sheet.

The non-woven, liquid-absorbent article is shaped to match the contour of the cavity in the first polymeric sheet. It is preferably die cut. The specific thickness, density etc. of the article is governed by the seven (7) critical features presented more fully below, not the least of which is the volume of the chemiluminescent composition employed. The article is chemically inert and may be somewhat compressible. The article is made from a polyolefin or a polyester or glass fibers. The polyolefin may be polyethylene, polypropylene etc., preferably polyethylene, which is formed into a non-woven mat by compression or is formed into a porous condition such as is taught in U.S. Pat. Nos. 3,729,425 or 4,384,589, incorporated herein by reference. The porous polyethylenes are sintered, porous systems having a controlled porosity and having omni-directional, interconnecting pores. These products are available under the trade designation "Porex" ® porous plastics and "Porous Poly" ® from Porex Technologies, Corp. Fairlawn, N.J. In general, the pore size may vary from 1 to 200 microns, preferably 10–50 microns.

The polyester may be, for example, polyethylene glycol terephthalate, the preferred polyester; polybutylene glycol terephthalate; poly 1,4-cyclohexanedimethanol terephthalate and the like and may be formed into the non-woven article, for example, by compacting fibers thereof as is known in the art.

The glass fibers may be manufactured into the desired non-woven structure also as is known in the art. These non-woven glass structures are commercially produced by Whatman, Inc. of Clifton, N.J. and Gelman Sciences, Inc., Ann Arbor, Mich. and are preferably employed in the novel devices of the present invention in those instances where a high volume of light is desired over a short period of time.

The seven (7) critical criteria of the non-woven article, as mentioned above, are essential to the production of a satisfactory functional device. The seven criteria are as follows:

(1) The article must be capable of absorbing and retaining substantially the complete volume of the chemiluminescent composition to thereby result in substantially complete saturation of the article. If the article cannot absorb the volume of the chemiluminescent light composition, light will be emitted from the composition not absorbed, thereby resulting in the device emitting light from every surface thereof rather than concentrating the light in the liquid absorbent article and emitting it primarily from the cavity surface of the first sheet. Furthermore, if the article is not substantially completely saturated by the chemiluminescent composition, the emitted light will not be uniform across the cavity surface of the device because the composition will be concentrated in different locations across the surface of the liquid-absorbent article.

(2) The liquid-absorbent article must further be capable of allowing substantially complete mixing of the components of the chemiluminescent light composition once they are absorbed because, in the absence of such mixing, only localized emission of light will occur across the surface of the device. This requirement is vital in that, ofttimes, one of the components is absorbed into the article upon manufacture of the device, the other component being contained in a rupturable receptacle. Thus, rupture of the receptical allows the released component to contact the article containing the already absorbed component and unless complete mixing of the two components is effected, poor light emission results. This limitation is less critical when the components of the chemiluminescent composition are substantially completely admixed before contact with the liquid-absorbent article, as discussed below.

(3) The liquid-absorbent article must have a uniform density across its face. Such uniform density contributes to the satisfactory conformance of requirements, (1) and (2) above, since, unless the density is uniform, uniform absorbance, saturation and mixing is improbable.

(4) The liquid-absorbent article must not be chemically reactive with the chemiluminescent light composition and its components to the extent that the light formation is retarded since reaction between the components must be effected before light is emitted. Thus, if the liquid-absorbent article deleteriously chemically or physically interferes with the reaction of the components, the quantity, quality and intensity of the resultant chemiluminescent light can be seriously retarded or negated altogether.

(5) If the liquid-absorbent article is deformable, i.e., loses its shape or continuity in the device, the light emitted will again be concentrated in that area of the cavity to which the deformed article moves upon activation during use of the device. Thus, the liquid-absorbent article must be non-deformable, although it may be compressible in that it compresses when the device is subject to pressures such as required to rupture the receptacle, however, the article must remain in place during use of the device and also retain its shape in conformity to the shaped cavity.

(6) The liquid-absorbent article must be capable of substantially instantaneous absorption of the chemiluminescent composition and or its components in order that the light created be centralized in the article and not in other void spaces in the device or even inside the ruptured receptacle. It is essential that all the liquid involved be positioned in the liquid-absorbing article and that the remaining interior of the device be as dry and light-free as possible. Rapid absorption creates such a result.

(7) The material from which the liquid-absorbent article is made must be substantially opaque once it is completely wetted with the absorbed liquid because, if translucent, the light emitted is materially affected, especially from an aesthetic appearance, by the revelation of the debris, i.e., broken ampoules, ruptured receptacles, distributor plate, etc., behind the light. The result is areas of lighter and darker consistency upon visual observation of the light emitting device.

The first sealed, breakable or rupturable receptacle contains the first liquid component of the chemiluminescent light composition. The receptacle is preferably composed of glass, i.e., may comprise a glass ampoule, however, the receptical may also constitute a pouch. The main function of the receptacle is to segregate the chemiluminescent liquid contents therein from the second chemiluminescent liquid component, however, protection of the contained component from moisture, oxygen etc., and/or actinic light is also a favorable effect thereof. A preferred pouch is made from a heat-sealable polyethylene/foil/polypropylene/polyethylene film laminate. It is chemically inert and provides a light and moisture barrier. The oxalate portion of the chemiluminescent light composition is usually packaged in such a pouch. The receptacle is sized to fit the device above the liquid-absorbing article in close proximity to the cavity and holds the volume of liquid which the article must absorb in conjunction with the second liquid component. In preparing the liquid filled receptacle, some nitrogen gas, liquid nitrogen, argon gas, etc. used to flush the receptacle may be trapped therein. In the case of the plastic pouch receptacle, the gas etc. oftimes, causes the pouch to assume a pillow shape and thereby assists in rupturing the pouch upon activation of the device.

The second liquid component of the chemiluminescent light composition may be present in the device as such, i.e., as absorbed on the non-woven, liquid-absorbent article or in its own sealed, breakable or rupturable recepticle, as discussed above with regard to the first component. The second component usually comprises the peroxide portion of the chemiluminescent composition. Thus, one chemiluminescent composition component may be present in a recepticle or both may be present in individual receptacles. The recepticle can be a glass ampoule, for example, or can be a rupturable pouch. Alternatively, each component may be in its own ampoule and both ampoules may be packaged in a pouch, in which case the pouch may not be a foil pouch and need not be sealed an all sides. In this configuration, the breakage of the ampoules in the pouch, which should be chemically inert, allows initial mixing of the components before contact with the liquid-absorbing article, thereby assuring even greater uniformity of light emission.

The second, polymeric sheet may be prepared from the same material as the first sheet and is usually slightly thicker, ranging in thickness from about 0.02 to 0.06 inch. It also is chemically inert, flexible and puncture resistant. A suitable material from which both the first and second polymeric sheets are preferably prepared is a propylene copolymer sold by Himont, U.S.A., Inc. of Wilmington, Del. as Profax®. The second sheet may be die cut, injection molded or thermoformed and it may contain a molded step inside its periphery to reduce bulging of the device caused by pressures resulting from the chemical reaction of the components once activation is effected. The peripheries of the first and second polymeric sheets are sealed together to form a non-rupturable bond by bar heating or ultrasonic sealing, for example, for about 5–10 seconds.

The second polymeric sheet may have an adhesive area on its outer surface which enables the attachment of the device to a substrate. The adhesive area may be covered with a protective paper layer to protect it from losing its adhesive character, said paper being removable to expose the adhesive.

In a further embodiment, a perforated plastic sheet may be positioned between the non-woven, liquid-absorbing article and the receptacle or receptacles containing the component or components of the chemiluminescent light composition. This plastic sheet acts as a dispenser, its perforations causing the liquid from the ruptured receptacle(s) to be more uniformly dispensed atop the non-woven article and thus aiding in the mixing and the uniform distribution of the composition over the complete area of the article. The perforations in the sheet can range from about 5 to about 500 microns in diameter and the sheet can comprise any inert polymeric material. The dispenser may be added to the device in a disengaged manner or may be heat or sonically sealed to the interior of the device.

When one of the chemiluminescent light components is retained in a rupturable pouch, means may be positioned inside the device to assist in the rupture of the pouch. To this end, a puncturing means such as a spike or spikes may be positioned adjacent the pouch such as by molding said means into the perforated plastic distributing sheet, or into the inside surface of the second, opaque polymeric sheet, whereby compression of the device will cause the spike to puncture the pouch.

The chemiluminescent light components may be comprised of those chemicals known in the art to create light chemically upon mixing, those disclosed in any of the above specified patents being exemplary. Any such chemicals may be used in the instant device without detracting from the usefulness of the device. A typical yellow chemiluminescent light composition is comprised as follows:

| Oxalate Component | | Activator Component | |
|---|---|---|---|
| Dibutyl Phthalate | 88.6% | Dimethyl Phthalate | 81.40% |
| CPPO* (luminescer) | 11.1% | T-butyl alcohol | 13.30% |
| CBPEA* (fluorescer) | 0.3% | 90% aq. $H_2O_2$ | 5.29% |
| | | Sodium Salicylate | 0.01 |

CPPO = bis(2,4,5-trichloro-6-carbopentoxyphenyl)oxalate
CBPEA = 1-chloro-9,10-bis(phenylethynyl)anthracene The following examples are set forth for purposes of illustration only and are not to be construed as limitations on the present invention except as set forth in the appended claims. All parts and percentages are by weight unless otherwise specified.

EXAMPLE 1

A first 3"×3" sheet of 0.035" low density polyethylene is thermoformed to impart a 2"×2" square cavity thereto, ¼" in depth. A 2"×2" square of a chemically-inert, non-woven, fibrous, polyethylene terephthalate polyester mat (PE 7111 from American Felt & Filter Co.) of 0.050" in thickness and having a uniform density across its surface is placed into the cavity. 1.0 Part of the "activator component" disclosed above is absorbed into the web. A pouch (1¾"×1½") made from polyethylene/polypropylene/foil/polyethylene with a seal coating of ethylmethacrylate is charged with 3.0 parts of the "oxalate component" disclosed above and hermetically heat sealed around the outside ¼" periphery thereof. The pouch is placed atop the mat and a 3"×3" sheet of low density polyethylene is placed atop the pouch in peripheral alignment with the cavity containing first sheet and the resultant assembly is impulse heat sealed for 20–40 seconds around the outer ¼" periphery thereof. The resultant device resists pressure up to about 5 psi. The device is squeezed to cause rupture of the pouch and kneaded to assist in removing all the liquid therefrom. The mat absorbs and retains the entire amount of liquid in the device and is completely saturated thereby almost instantaneously. The components of the chemiluminescent light composition mix thoroughly as evidenced by the uniform yellow light which immediately emits from the outer cavity surface. The mat does not deform when the device is shaken or otherwise used and is opaque as evidenced by the absence of any indication of the ruptured pouch behind the emitted light. Further, evaluation of the device is set forth in Table I, below.

EXAMPLES 2–17

Following the procedure of Example 1, except that equivalent size mats of other commercially available materials are substituted for that set forth therein, devices are produced and evaluated for light efficiency. The results are set forth in Table I, below.

TABLE I

| EXAMPLE | WEB MATERIAL | LUMINANCE (ft. lambert/hrs) 2 hr. | 6 hr. | COMMENTS |
|---|---|---|---|---|
| | POLYESTERS | | | |
| 1 | PE-7111 | 13.2 | 40.7 | Excellent mixing/uniformity Retention & light output |
| 2 | EX-893*-10 oz/yd$^2$ (.060" thick) | 20.9 | — | Good light output; liquid retention |
| 3C | EX-893*-10 oz/yd$^2$ (.030" thick) | 5.8 | — | poor light output/stiff does not conform to shape of device |
| 4C | EX-893*-5 oz/yd$^2$ (.090" thick) | 18.6 | 60.2 | poor liquid retention |
| 5C | PET (Chicopee 5470)** | 2.3 | — | Poor light output not opaque |
| | POLYOLEFINS | | | |
| 6C | Polypropylene PPI6P - (Fibredyne)[1] | 15.3 | 17.3 | Stiff/non-conforming |
| 7C | Polypropylene 5-1* | 23.1 | 31.3 | Dark spots/non-uniform (material not dense enough) |
| 8C | Polypropylene 5-2* | 21.2 | — | Dark spots/non-uniform (material not dense enough) |
| 9 | Polypropylene 62PO(3)6/125* | 20.3 | — | Good mixing/uniformity retention and light output |
| 10C | Polypropylene with PET veil 62PO(3)3/060* | 17.9 | | spotty/not dense enough/fuzzy appearance |
| | GLASS FIBERS | | | |
| 11 | Whatman[2] Glass 934-AH | 14.8 | — | Good mixing/uniformity; retention light output short duration |
| 12 | Gelman[3] Extra Thick | 32.9 | — | Good Light output, short duration |
| | OTHERS | | | |
| 13C | 100% Acrylic | 10.6 | 22.1 | High liquid volume Low light output |
| 14C | Dacron[4] | 20.8 | 25.0 | Too much liquid needed for uniform light output |
| 15C | Viscose Rayon 64 RV/PO 13 EOS* | 9.8 | — | Poor absorbance/mixing |
| 16C | Kendall[5] 149-9 oz. Cotton/Polypropylene | 5.3 | — | Too thin-deforms/poor light output/transparent |
| 17C | Kendall[5] 9903 Rayon/Polypropylene | 5.8 | — | Poor light output |

C = comparative
PET = polyethylene glycol terephthalate
*American Felt & Filter Co.
**Johnson & Johnson Co, New Brusnwick, N.J.
[1]National Felt Co., North Hampton, Mass.
[2]Whatman, Inc., Clifton, N.J.
[3]Gelman Sciences, Inc., Ann Arbor, Michigan
[4]E. I. Du Pont de Nemours, and Co., Wilmington, Del.
[5]Colgate Polmolive, Co., Boston, Mass.

EXAMPLE 18

The procedure of Example 1 is again followed except that a sheet of perforated, 0.001 inch thick, opaque, white, low density polyethylene, film is heat sealed to the surface of the mat closest to the pouch. Similar results are achieved except that uniform dispersion of the pouch liquid throughout the mat is somewhat more rapidly obtained.

EXAMPLE 19

Again following the procedure of Example 1 except that a loose film of 0.001 inch thick, opaque, low density polyethylene having a 1/16 inch high spike molded into the center thereof is placed between the mat and the pouch. Upon applying pressure, the pouch is quickly and easily ruptured. Similar results are observed.

EXAMPLE 20

A cavity is thermoformed into a 3"×3", 25 mil polypropylene copolymer (Profax® from Himont, U.S.A., Inc.) sheet in the shape of a 2¼" heart, ½" in depth. A 2¼" liquid absorbent article made of polyethylene glycol terephthalate polyester (PE7111) from American Felt and Filter, Co., (0.050" thick and approximately 9 ounces per square yard) is placed within the cavity. 1.4 Parts of activator solution and 1.7 parts of oxalate solution (both as above in Example 1) each contained within a separate, crushable, glass ampoule are placed with the cavity. A 3"×3" flat sheet of the above polypropylene copolymer is placed on top of the cavity and the assembly is sonically sealed around the perimeter to produce a leak-proof bubble. Activation of the resultant device by rupturing the ampoules instantaneously results in a yellow light emission from the article, which light is uniform across the surface of the "heart." No unabsorbed liquid is evident in the device and strenuous agitation does not deform the glowing article. The seven criteria expressed above are fully satisfied.

EXAMPLE 21

The procedure of Example 20 is followed except that both ampoules are placed within a square pouch composed of polyethylene plastic chemically inert to the chemiluminescent system. The pouch is sealed only on three sides. The ampoules in the pouch are sealed within the cavity. The ampoules are crushed within the pouch thereby mixing the two chemicals and the pouch is then tipped to allow the chemicals to drain therefrom. The liquid is instantaneous absorbed by the article to obtain a uniform yellow glowing surface substantially identical to that of Example 20.

EXAMPLE 22

A liquid-absorbent article composed of polyethylene glycol terephthalate polyester is placed within a thermoformed cavity as described in Example 20. 1.4 Parts of activator solution are evenly distributed across the surface of the polyester. 1.7 Parts of oxalate component are sealed into a crushable glass ampoule which is then placed within the cavity. Activation occurs once the ampoule is broken, resulting in a device similar to that of Example 20.

EXAMPLE 23

The procedure of Example 20 is again followed except that the copolymer sheet is thermoformed into an arrow and a green fluorescer is used in the oxalate solution. Again, an excellent device is produced which glows green in the area of the arrow configuration.

EXAMPLE 24

The procedure of Example 23 is followed except the thermoformed shape is that of the letter "A". Similar results are achieved.

I claim:

1. A chemiluminescent device comprising, in sequential relationship,

A. a first polymeric sheet of 0.01–0.5 inch thickness being translucent or transparent and having a shaped cavity therein, said cavity capable of receiving a liquid-absorbent article, B. a non-woven, liquid-absorbent article made from a polyolefin, a polyester or glass fibers, said article being of substantially the same shape as said cavity, c. a first sealed, breakable receptacle containing a quantity of a first liquid component of a chemiluminescent light composition capable of providing chemiluminescent light when mixed with a second component, D. a quantity of a second liquid component of a chemiluminescent light composition outside said first sealed receptacle, and E. a second polymeric sheet of 0.2–0.6 inch thickness, sealed around its perifery to the periphery of said first polymeric sheet, the sum of the quantities of components C and D being such that when absorbed on component B, component B is substantially completely saturated thereby, said liquid-absorbent article:

(i) being capable of absorbing and retaining substantially the complete volume of said chemiluminescent light composition to thereby result in substantially complete saturation of the article;

(ii) being capable of allowing mixing of said first and second components of said composition after being absorbed thereby;

(iii) having a uniform density across its widest surface;

(iv) being inert with regard to said composition and said first and second components;

(v) being substantially non-deformable in use in said device;

(vi) being capable of substantially instantaneous absorption of said first and second components, alone or when admixed, and (vii) being opaque when substantially completely saturated with said chemiluminescent composition.

2. A device according to claim 1 wherein said nonwoven article is made from polyethylene.

3. A device according to claim 2 wherein said polyethylene is porous.

4. A device according to claim 1 wherein said nonwoven article is made form polyethylene glycol terephthalate.

5. A device according to claim 1 wherein said nonwoven article is made from glass fibers.

6. A device according to claim 1 wherein said first and second polymeric sheets are composed of a polypropylene copolymer.

7. A device according to claim 1 wherein said cavity is in the shape of a heart.

8. A device according to claim 1 wherein said cavity is in the shape of a arrow.

9. A device according to claim 1 wherein said first component is a solution of an oxalate.

10. A device according to claim 1 wherein said second component is a solution of hydrogen peroxide.

11. A device according to claim 1 containing:

F. a second, sealed, rupturable receptacle containing said second liquid component and abutting said first receptacle.

12. A device according to claim 11 wherein said second receptacle is in the form of a glass ampoule.

13. A device according to claim 11 wherein said first and second receptacles are packaged in a pouch.

14. A device according to claim 11 wherein both said first and second receptacles are in the form of glass ampoules.

15. A device according to claim 14 wherein said first and second glass ampoules are packaged in a pouch.

16. A device according to claim 1 wherein said first receptacle is in the form of a pouch.

17. A device according to claim 1 wherein said second liquid component is absorbed onto said article.

18. A device according to claim 1 wherein said first receptacle is in the form of a glass ampoule.

19. A device according to claim 1 wherein the peripheries of said first and second polymeric sheets are sonically sealed.

* * * * *